US005152613A

United States Patent [19]

Herrington, Jr.

[11] Patent Number: 5,152,613

[45] Date of Patent: Oct. 6, 1992

[54] PLASTIC FILM ZIPPER BAG HAVING STRAIGHTENED HEAT SEALS

[75] Inventor: F. John Herrington, Jr., Holcomb, N.Y.

[73] Assignee: Mobil Oil Corporation, Fairfax, Va.

[21] Appl. No.: 674,647

[22] Filed: Mar. 22, 1991

[51] Int. Cl.[5] ..... B65D 33/16

[52] U.S. Cl. ..... 383/63; 156/66; 156/84; 156/183

[58] Field of Search ..... 383/63, 65, 15; 156/66, 156/84, 183

[56] References Cited

U.S. PATENT DOCUMENTS 3,173,184 9/1962 Ausnit .
3,259,951 7/1964 Zimmerman .
4,479,244 10/1984 Ausnit ..... 383/63
4,698,118 10/1987 Takahashi ..... 156/66
4,976,811 12/1990 Siebert ..... 383/65

*Primary Examiner*—Stephen P. Garbe
*Attorney, Agent, or Firm*—Alexander J. McKillop; Charles J. Speciale

[57] ABSTRACT

In the manufacture of thermoplastic film zipper bags and the like heat sealing the film to the zipper produces a seal line that shrinks, resulting in unsightly apearance. A system and method are disclosed for restoring the shrunk seal line to its orginal length by corrugating and stretching it between mating teeth. A method is also disclosed for restretching the seal without corrugation.

1 Claim, 2 Drawing Sheets

FIG. 2
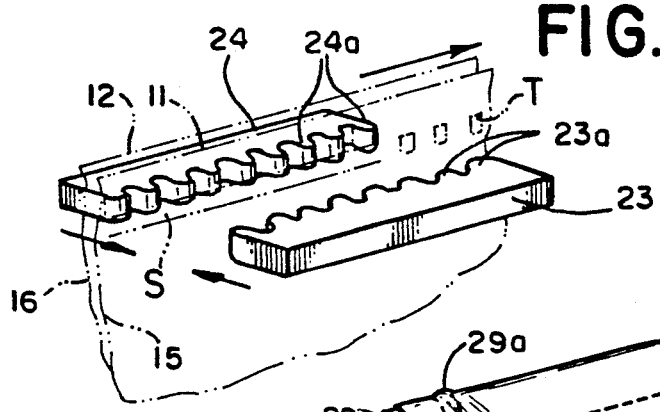
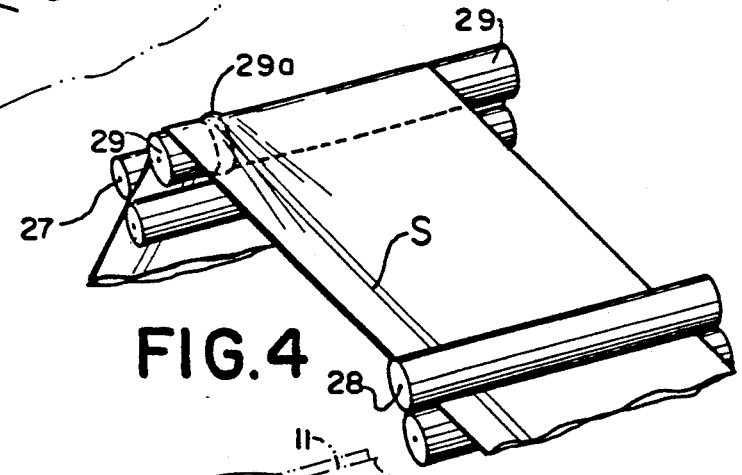
FIG. 4
FIG. 3
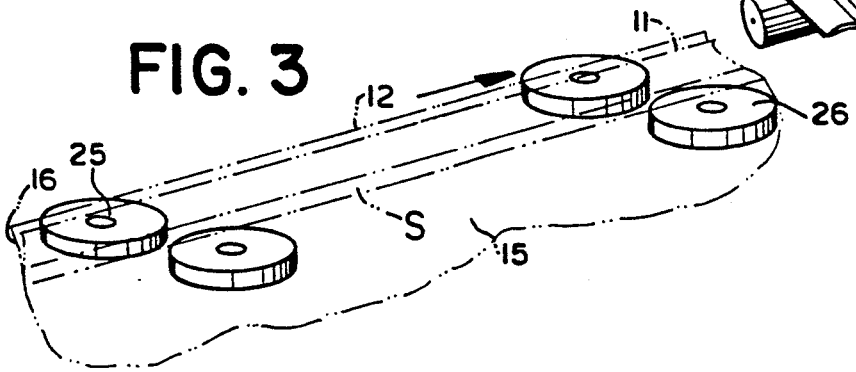
FIG. 5
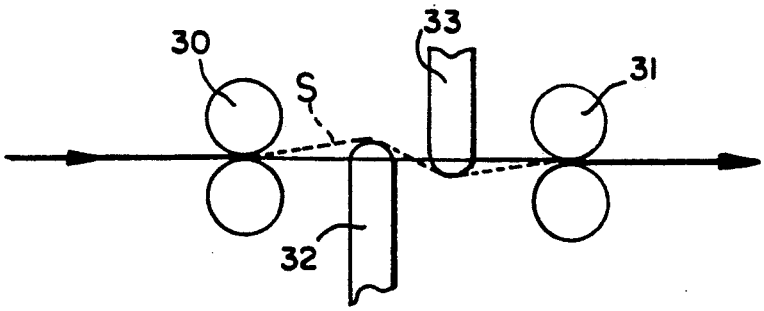

PLASTIC FILM ZIPPER BAG HAVING STRAIGHTENED HEAT SEALS

BACKGROUND OF THE INVENTION

The present invention relates to improvements in the manufacture of plastic film zipper bags and the like and particularly to a method of straightening the zipper fin seal. Plastic zippers with or without sliders are well known in the art. The plastic zippers have profiles and include a pair of male and female fastener elements in the form of reclosable interlocking rib and groove elements. Where a slider is employed, the slider will open and close the rib and groove elements. In the manufacture of thermoplastic film bags, a pair of these male and female fastener elements extend along the mouth of the bags and these male and female elements are adapted to be secured in any suitable manner to the flexible walls of the thermoplastic film bags. While these elements may be integral marginal portions of such walls, the present invention is directed to bags where the zipper elements are extruded separately and thereafter are attached to the walls along the mouth of the bag. Examples of plastic film zipper bags of this type are disclosed in U.S. Pat. Nos. 3,173,184 and 3,259,951.

In the manufacture of plastic film zipper bags of the type having an integral plastic fin and zipper, the bag film is heat sealed to the fin of the zipper track. Normally, the thickness of the bag film is small (about 1.75 mil) compared to that of the fin (about 6 mil). The heating and melting causes the fin and the film to shrink along the line of the seal, as the orientation of the plastic is relaxed. This causes an unsightly appearance, with puckering of the adjacent material, and a bending downward of the top portion of the bag. It is difficult to prevent this shrinkage by process conditions.

It is an object of the present invention to overcome such shrinkage problem.

SUMMARY OF THE INVENTION

The present invention relates to the manufacture of plastic film zipper bags of the type having an integral plastic fin and zipper and specifically the method of heat sealing the fin to the plastic film thereby causing the fin and film to shrink along the line of the seal, cooling the seal area and thereafter stretching the seal along the line to the original length corresponding to the length of the film and zipper adjacent the seal area to thereby straighten the seal. In accordance with one aspect of the invention the shrunk seal is selectively stretched back to the original length by pressing the seal between corrugating teeth causing only the seal area to take a longer path thereby elongating the shrunk seal to the original length. In one form of the invention, the corrugating teeth are on reciprocating mating bars. In another form of the invention the corrugating teeth are on mating rotating disks.

In accordance With a further aspect of the invention the seal is stretched by passing the seal through successive nip wheels having the width of the seal with the second wheel running faster than the first. In accordance with another aspect of the invention the seal is stretched by passing the film between successive nip rolls running at the same speed as the film and between the rolls diverting the path of the seal to increase its path length as compared to the path length of the remainder of the film. In one form of the invention, the path length of the seal is increased by diverting the path of the seal over an idler roll having a circumferential portion engaging the seal of larger diameter than the remainder of the idler roll. In accordance with another form of the invention the path length of the seal is increased by pulling the seal over a plurality of fingers positioned to increase the path length of the seal as compared to the path length of the remainder of the film.

BRIEF DESCRIPTION OF THE DRAWINGS

FIG. 2 is a diagrammatic view of a modification of the stretching station in the system illustrated in FIG. 1.

FIG. 3 is a diagrammatic view of another modification of the stretching station in the system for straightening the zipper fin seal illustrated in FIG. 1.

FIG. 4 is a diagrammatic view of a further modification of the stretching station in the system illustrated in FIG. 1.

FIG. 5 is a diagrammatic view of another modification of the stretching station in the system illustrated in FIG. 1.

PREFERRED EMBODIMENT OF THE INVENTION

Figure 1:
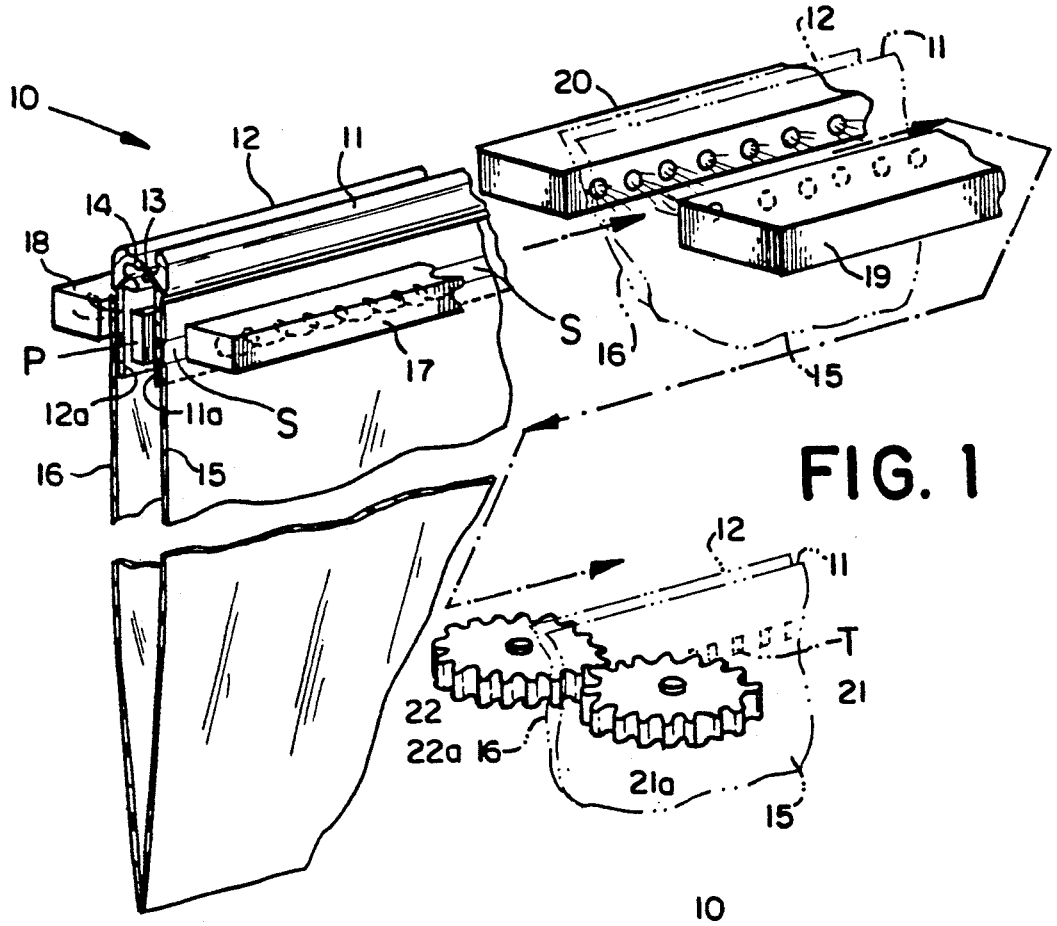
FIG. 1 is a diagrammatic view of a system for straightening the zipper fin seal in accordance with the present invention.

Referring to FIG. 1 there is diagrammatically illustrated a system for straightening the zipper fin seal in accordance with the present invention. There is illustrated a profiled plastic reclosable fastener or zipper 10 particularly suited for use in connection with thermoplastic bags and the like. The zipper 10 is adapted to be assembled at the top edge or mouth of a thermoplastic bag. The bag may be made from any suitable thermoplastic film such for example as polyethylene or polypropylene or equivalent material. In the preferred form of the invention the bag is made from extruded polyethylene film having a thickness of about 1.75 mil and the zipper is made from extruded polyethylene with a fin having a thickness of about 6 mil.

The zipper 10 comprises a pair of flexible plastic strips 11 and 12 having separable plastic means extending along the length thereof comprising reclosable interlocking male and female profile elements in the form of rib and groove elements 13 and 14 on the respective strips. Each of the extruded strips 11 and 12 includes a thin fin section or portion 11*a*, 12*a* depending therefrom and which are adapted to be inserted between the spaced walls 15, 16 of a center folded thermoplastic film to form a web from which a plurality of bags are to be made. This creates a four-layer region at one edge of the web comprising film 15, fin 11*a*, fin 12*a*, and film 16. The web including the four-layer region is pulled (by means not shown) in the direction of the arrow through a heat sealing station including spaced hot air jets 17, 18 which weld the outer film layers 15 and 16 to the adjacent fins 11*a* and 12*a* along continuous seal lines S. A plate P is positioned between the fins at the sealing station to prevent fusing the fins to each other. The seals S of the web are then passed through a cooling station where they are cooled with chilled air jets 19 and 20.

Figure 1A:
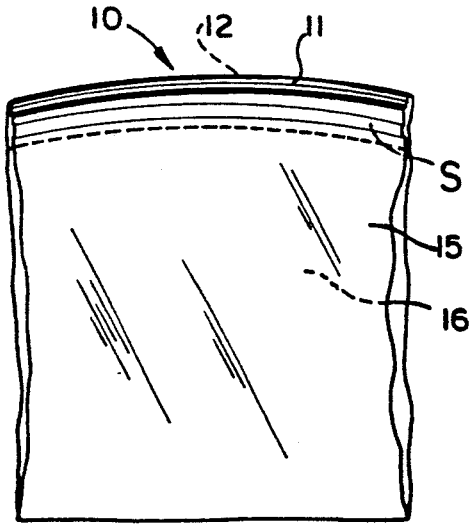
FIG. 1A is a view illustrating the effect of the shrinkage after the heat sealing of the zipper fin seal.
Figure 1B:
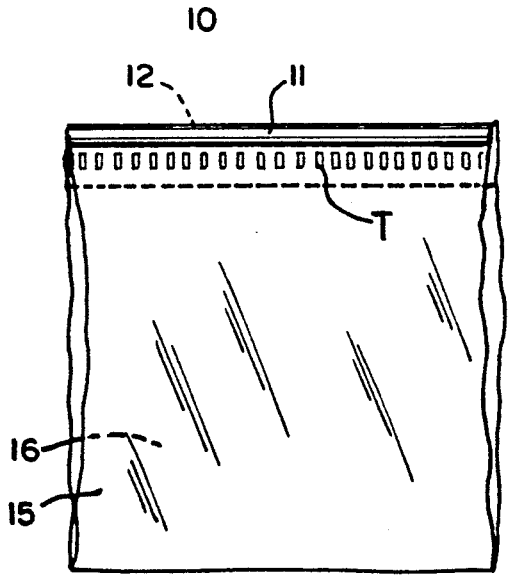
FIG. 1B is a view illustrating the zipper fin seal after straightening.

The plastic fin portions 11*a*, 12*a* have a high machine direction orientation as they come from the zipper extrusion process. The application of heat to seal the film to the fin causes this orientation to relax resulting in undesirable shrinkage of the fins in the seal region S in the machine direction. This is illustrated in FIG. 1A where there is a puckering of the material adjacent the seal line S and a bending down of the zipper 10. To counter this effect, the seal S is stretched back to its original length after cooling by running it through a stretching station which includes a pair of mating spur gears 21, 22 having a width corresponding to the width of the seal line S. The gears 21, 22 each have a profile which engages the seal S including rounded teeth 21*a*, 22*a* to prevent damaging the film web and the fins along the seal line S. The result is a straight web with embossed appearance of zipper teeth T as illustrated in FIG. 1B.

Referring to FIG. 2 there is diagrammatically illustrated a modification of the stretching station in the system illustrated in FIG. 1. The heat sealing and cooling stations are the same as those illustrated in FIG. 1. The difference in the two systems is in the stretching station where the seal S is stretched along the seal line to the original length corresponding to the length of the film and zipper adjacent the seal area to thereby straighten the seal. At the stretching station the mating gear wheels 21 and 22 of the system shown in FIG. 1 have been replaced by mating gear racks 23 and 24 having meshing teeth 23*a* and 24*a* respectively. The seal S is stretched back to its original length after cooling by pressing it between the pair of mating gear racks 23 and 24. The gear racks are adapted for reciprocation toward and away from each other and the seal S is advanced intermittently between the gear racks 23 and 24. The teeth 23*a* and 24*a* on the gear racks have profiles which prevent damaging the film web and fins on the zipper. After the web passes through the gear racks 23, 24 at the stretching station, the result is a straightened web with embossed appearance of zipper teeth similar to that shown in FIG. 1B.

Referring to FIG. 3 there is diagrammatically illustrated another modification of the stretching station in the system for straightening the zipper fin seal illustrated in FIG. 1. The heat sealing station and the cooling station are the same as those illustrated in FIG. 1. The basic difference in the systems is at the stretching station. In the system of FIG. 3 after the film web and fins leave the heat sealing and cooling stations the seals S pass through successive nip wheels 25, 26. It will be noted that the nip wheels 25 and 26 have a width that corresponds to the width of the seal S. The second nip wheel 26 is driven at a faster speed than the first nip wheel 25 thereby stretching the seal S back to its original length. The result is a straight web similar to FIG. 1B but without the embossed appearance.

Referring to FIG. 4 there is diagrammatically illustrated a further modification of the stretching station in the system illustrated in FIG. 1. In this system the heat sealing station and the cooling station are the same as those illustrated in FIG. 1 and the change again is made only at the stretching station. In this system after the film web and fins leave the heat sealing and cooling stations they run between full-width nip rolls 27, 28 running at the same speed as the film. Between the nip rolls 27, 28 is an idler roll 29 which diverts the path of the seal S to increase its path length as compared to the path length of the remainder of the film. The length of the seal S is increased by diverting the path of the seal S over the idler roll 29 having a raised circumferential portion 29*a* engaging the seal S of a larger diameter than the remainder of the idler roll 29. This causes the seal S to stretch back to its original length resulting in a straight web similar to FIG. 1B but without the embossed appearance.

Referring to FIG. 5, there i diagrammatically illustrated another modification of the stretching station in the system illustrated in FIG. 1. In this system, the heat sealing station and the cooling station are the same as those illustrated in FIG. 1 and the change is made only at the stretching station. In this system after the film web and ends leave the heat sealing and cooling stations they run between full-width nip rolls 30 and 31 running at the same speed as the film. The nip rolls 30 and 31 are similar to the nip rolls 27 and 28 of FIG. 4. However, in place of the idler roll 29 of FIG. 4 there is positioned between the nip rolls 30 and 31 in FIG. 5 a pair of fingers 32 and 33 which divert the path of the seal S to increase its path length as compared to the path length of the remainder of the film. The length of the seal S is increased by diverting the path of the seal S over the fingers 32 and 33 which have a width corresponding to the width of the seal S. This causes the seal S to stretch back to its original length resulting in a straight web similar to FIG. 1b but without the embossed appearance.

It is to be understood that after the web has been straightened and leaves the stretching station of the system it is ready to be processed into completed bags with the conventional side seals. As pointed out above, the zipper may be provided with sliders such for example as disclosed in copending application Ser. No. 490,110 filed Mar. 7, 1990 for Rolling Action Zipper Profile and Slider Thereof assigned to the assignee of the present application.

While a preferred embodiment and certain modifications of the invention have been described and illustrated, it is to be understood that further modifications thereof may be made within the scope of the appended claims without departing from the spirit of the invention. For example while both of the seals S are illustrated as being stretched with each other, the seals S can be stretched individually by opening the zipper 10 and stretching each seal S at separate stretching stations. While the present invention has been described in connection with the manufacture of plastic film zipper bags, it is to be understood that the invention is applicable to other types of articles which have a plurality of flexible plastic layers to be heat sealed to each other where at least one of the layers has an orientation in the direction of the seal. In practicing the present invention, the at least one oriented layer is heat sealed to another of the layers thereby causing both layers to shrink along the line of the seal. The seal area is then cooled and thereafter the seal is stretched along the line to the original length corresponding to the length of the layers adjacent the seal area to thereby straighten the seal. The apparatus described and illustrated herein is suitable for practicing the method on other thermoplastic articles as well as plastic film zipper bags.

What is claimed is:

1. A plastic film zipper bag wherein the zipper comprises a pair of extruded flexible plastic strips having reclosable interlocking profile elements in the form of rib and groove elements on the respective strips, each of the extruded strips including a thin fin section depending therefrom and heat sealed to the plastic film thereby causing the film to shrink along the line of the seal, the shrunk seal being selectively stretched back to the original length by pressing the seal between corrugating teeth thereby elongating the shrunk seal to the original length resulting in a straight seal with an embossed appearance of zipper teeth.

* * * * *